US008023878B2

(12) United States Patent
Fukuda et al.

(10) Patent No.: US 8,023,878 B2
(45) Date of Patent: Sep. 20, 2011

(54) CLEANING DEVICE AND IMAGE FORMING APPARATUS USING THE SAME

(75) Inventors: Yuichi Fukuda, Kanagawa (JP); Noriaki Kojima, Kanagawa (JP); Makoto Sakanobe, Kanagawa (JP); Hiromi Nagai, Kanagawa (JP); Hiroaki Akamatsu, Kanagawa (JP); Masahiro Katahira, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 12/543,635

(22) Filed: Aug. 19, 2009

(65) Prior Publication Data

US 2010/0247188 A1 Sep. 30, 2010

(30) Foreign Application Priority Data

Mar. 25, 2009 (JP) ..... 2009-074960

(51) Int. Cl.
*G03G 21/00* (2006.01)

(52) U.S. Cl. ..... 399/350

(58) Field of Classification Search ..... 399/111, 399/123, 350, 351
See application file for complete search history.

(56) References Cited

U.S. PATENT DOCUMENTS 6,393,250 B1 * 5/2002 Tsukida et al. ..... 399/350

FOREIGN PATENT DOCUMENTS

| | | | |
|---|---|---|---|
| JP | 08292690 A | * | 11/1996 |
| JP | 2002-214989 | | 7/2002 |
| JP | 2002-214990 | * | 7/2002 |
| JP | 2003-215995 | | 7/2003 |
| JP | 2003-241599 | * | 8/2003 |
| JP | 2004-205881 | * | 7/2004 |
| JP | 2004-264792 | | 9/2004 |
| JP | 2005-025078 | | 1/2005 |

OTHER PUBLICATIONS

Machine translation of JP 08292690.*

* cited by examiner

*Primary Examiner* — David Gray
*Assistant Examiner* — Barnabas Fekete
(74) *Attorney, Agent, or Firm* — Fildes & Outland, P.C.

(57) ABSTRACT

A cleaning device includes a cleaning blade that contacts a surface of a member to be cleaned to remove a residue remaining on the surface of the member to be cleaned, and that includes multiple layers, wherein a leading end portion of the cleaning blade shifts in a separating direction from the surface of the member to be cleaned due to a difference in thermal expansion property among the multiple layers when temperature rises.

7 Claims, 9 Drawing Sheets

CLEANING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2009-074960 filed on Mar. 25, 2009.

BACKGROUND

Technical Field

The present invention relates to a cleaning device and an image forming apparatus using such cleaning device.

SUMMARY

According to an aspect of the invention, there is provided a cleaning device including a cleaning blade that contacts a surface of a member to be cleaned to remove a residue remaining on the surface of the member to be cleaned, and that includes plural layers, wherein a leading end portion of the cleaning blade shifts in a separating direction from the surface of the cleaning-receiving member due to a difference in thermal expansion property among the plural layers when temperature rises.

BRIEF DESCRIPTION OF THE DRAWINGS

Exemplary embodiment(s) of the present invention will be described in detail based on the following figures, wherein:

FIG. 10 is a graphical representation of the worn state of the cleaning blade, wherein

50 denotes Cleaning blade, 54 denotes Cleaning layer, 55 denotes Back surface support layer, 56 denotes Plate metal holder, and 57 denotes Adhesive agent.

DETAILED DESCRIPTION

Now, description will be given below of an exemplary embodiment according to the invention with reference to the accompanying drawings.

Exemplary Embodiment 1

Figure 2:
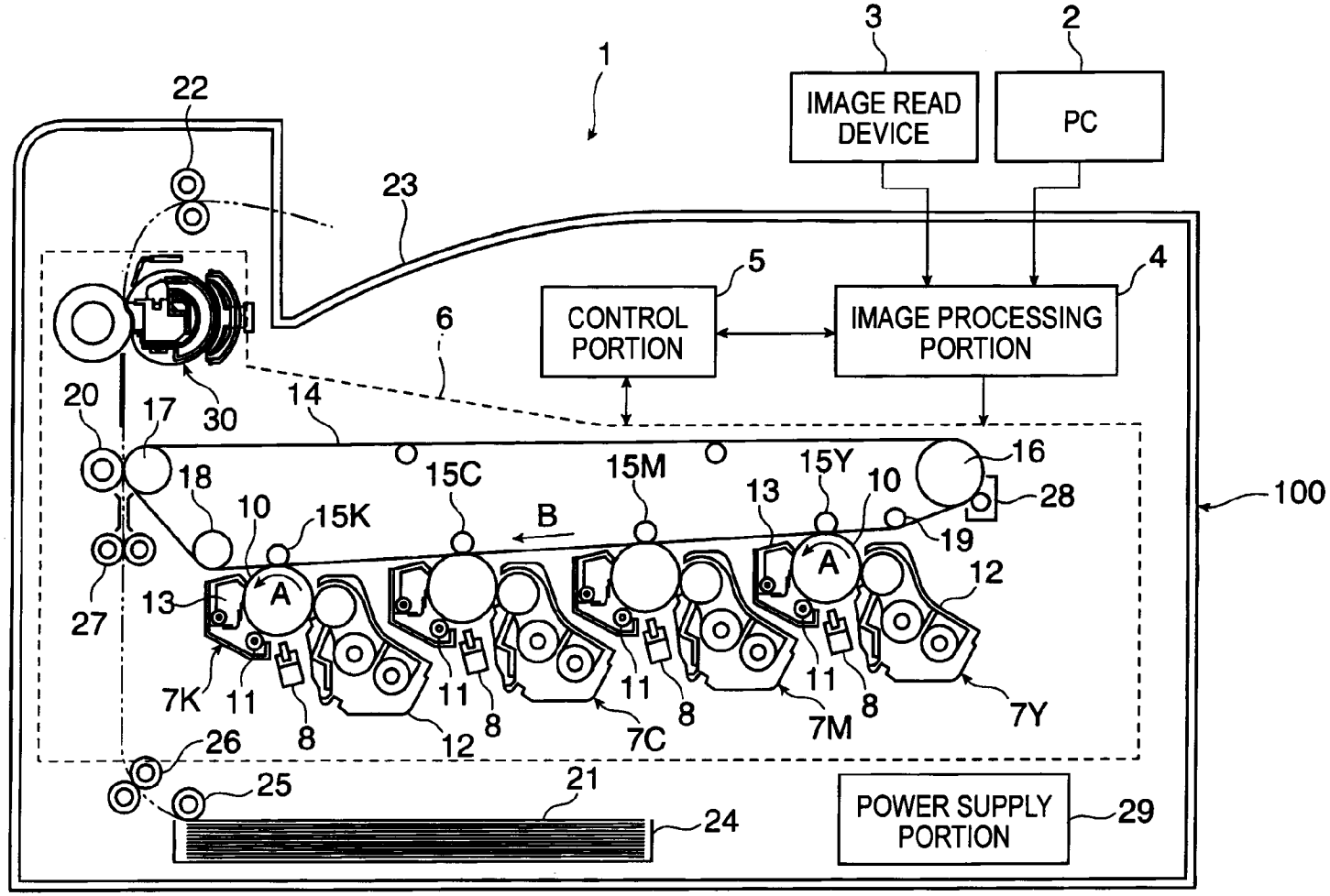
FIG. 2 is a structure view of a tandem type digital color printer serving as an image forming apparatus to which a cleaning device according to the exemplary embodiment 1 of the invention is applied.

FIG. 2 shows a color image forming apparatus serving as an image forming apparatus to which a cleaning device according to an exemplary embodiment 1 of the invention is applied. This color image forming apparatus 1 functions as a printer for printing image data transmitted from a personal computer (PC) 2 and also functions as a copying machine and a facsimile machine for copying the image of a manuscript (not shown) read by an image read device 3 and also for transmitting and receiving image information read by an image read device 3.

In the interior portion of the color image forming apparatus 1, as shown in FIG. 2, there are provided: an image processing portion 4 which, as the need arises, carries out predetermined image processings such as a shading correction processing, a position shift correction processing, a brightness/color space conversion processing, a gamma correction processing, a frame erasing processing, and a color/movement editing processing on the image data transmitted from the personal computer (PC) 2 or image reading device 3; and, a control portion 5 for controlling color image forming operations using the image data on which image processing has been executed by the image processing portion 4.

And, the image data, on which the predetermined image processing has been executed by the image processing portion 4 in the above-mentioned manner, are converted similarly by the image processing portion 4 into four color image data, that is, yellow (Y), magenta (M), cyan (C) and black (K) image data; and, as will be discussed next, a full color image and a monochrome image are output by the image output portion 6 provided within the color image forming apparatus 1.

The image data, which have been converted into the yellow (Y), magenta (M), cyan (C) and black (K) image data by the image processing portion 4, are then transmitted to the image exposure devices 8 of image forming units 7Y, 7M, 7C and 7K respectively for the yellow (Y), magenta (M), cyan (C) and black (K); and, in these image exposure devices 8, an image exposure processing is carried out by the light that is emitted from an LED light emitting element array according to the corresponding color image data.

In the interior portion of the color image forming apparatus 1, as shown in FIG. 2, the four image forming units (image forming portions) 7Y, 7M, 7C, and 7K respectively for yellow (Y), magenta (M), cyan (C) and black (K) are arranged parallel at a constant interval from each other and are inclined from the horizontal by a previously determined angle in such a manner that the image forming unit 7Y for the first color Yellow (Y) is situated relatively high and the image forming unit 7K for the last color Black (K) is situated relatively low.

In this manner, since the four yellow (Y), magenta (M), cyan C and black (K) image forming units 7Y, 7M, 7C and 7K are arranged such that they are inclined at the previously determined angle, when compared with a structure in which these four image forming units 7Y, 7M, 7C and 7K are arranged horizontally, the distance between the image forming units 7Y, 7M, 7C and 7K can be set short, which can reduce the width of the color image forming apparatus 1 and thus can reduce the size thereof.

These image forming units 7Y, 7M, 7C and 7K are basically structured similarly to each other except for the colors of the images to be formed by them. Each image forming unit, as shown in FIG. 2, includes mainly: a photosensitive drum 10 serving as an image carrier which can be rotatably driven at a predetermined speed along the arrow mark A direction by drive means (not shown); a charging roller 11 for primary charging which charges the surface of the photosensitive drum 10 uniformly; an image exposure device 8 made of an LED print head for exposing the image corresponding to the predetermined color to thereby form an electrostatic latent image on the surface of the photosensitive drum 10; a developing device 12 for developing the electrostatic latent image formed on the photosensitive drum 10 with a predetermined color toner; and, a cleaning device 13 for cleaning the surface of the sensitive drum 10.

As the photosensitive drum 10, for example, there may be used a member which is formed in a drum shape having a diameter of 30 mm, the surface of which is covered with an organic photoconductor including a smooth surface coat layer having the 10 point average roughness (Rz) of 0.3 μm or less; and, the photosensitive drum 10 can be driven and rotated at a previously determined speed along the arrow mark A direction by a drive motor (not shown).

Also, as the charging roller 11, for example, there may be used a roller-shaped charging device structured such that: it includes a core metal, the surface of which is covered with a conductive layer which is made of synthetic resin or rubber by which the electric resistance is adjusted; and, to the core metal of the charging roller 11, there is applied a predetermined charging bias.

The image exposure devices 8, as shown in FIG. 2, are arranged one each at the four image forming units 7Y, 7M, 7C and 7K. As the image exposure devices 8 provided one each at the four image forming units 7Y, 7M, 7C and 7K, there are used image exposure devices which include: an LED light emitting array in which LED light emitting elements are arranged linearly along the axial direction of the photosensitive drum 10 at a predetermined pitch (for example, 600 dpi-2400 dpi); and, a "Selfock lens" (trade name) array by which the images of the lights emitted from the respective LED light emitting elements of the LED light emitting element array can be focused in a spot on the photosensitive drum 10. Also, each of the image exposure devices 8, as shown in FIG. 2, is structured such that it can expose the image onto the photosensitive drum 10 by scanning from below.

Here, the image exposure device 8 is not limited to one which is made of LED light emitting elements but, of course, it is also possible to employ a device which can deflect and scan a laser beam along the axial direction of the respective photosensitive drums 10. In this case, a single image exposure device 8 is provided for the four image forming units 7Y, 7M, 7C and 7K.

From the image processing portion 4, to image exposure devices 8Y, 8M, 8C and 8K which are provided in the image forming units 7Y, 7M, 7C and 7K respectively for yellow (Y), magenta (M), cyan (C) and black (K), there are sequentially output the image data of the corresponding colors, and the light flux emitted from these image exposure devices 8Y, 8M, 8C and 8K corresponding to the image data is scanned and exposed on the surface of the corresponding photosensitive drums 10, whereby there are formed electrostatic latent images corresponding to the image data. The electrostatic latent images formed on the photosensitive drums 10 are developed by their associated developing devices 12Y, 12M, 12C and 12K into the toner images of the respective colors, that is, yellow (Y), magenta (M), cyan (C) and black (K). Here, in the developing devices 12Y, 12M, 12C and 12K, for example, there is used a two-component developer which includes a carrier having an average particle diameter of 30 μm and a toner having an average particle diameter of 7 μm.

The toner images of the respective colors, that is, yellow (Y), magenta (M), cyan (C) and black (K) sequentially formed on the photosensitive drums 10 of the image forming units 7Y, 7M, 7C and 7K are sequentially primarily transferred in a multiple manner by four primary transfer rollers 15Y, 15M, 15C and 15K onto an intermediate transfer belt 14 serving as a continuous belt intermediate transfer member which is arranged to extend diagonally above the respective image forming units 7Y, 7M, 7C and 7K.

This intermediate transfer belt 14 is a continuous belt shaped member pulled and held by multiple rollers; and, the lower side travelling area thereof is arranged to be inclined relative to the horizontal direction in such a manner that the downstream side in the traveling direction is relatively low, whereas the upstream side is relatively high.

That is, the intermediate transfer belt 14, as shown in FIG. 2, is rotated with constant tension around a drive roller 16, a back surface support roller 17, a tension applying roller 18 and a driven roller 19; and, the belt 14 can be circularly moved at a predetermined speed along the arrow mark B direction by the drive roller 16 which is driven and rotated by a drive motor (not shown) that is excellent at maintaining constant speed. As the intermediate transfer belt 14, for example, a synthetic resin film made of flexible polyimide or polyamide or the like may be formed into a belt shaped film, the two ends of the belt-like formed synthetic resin film connected together by welding or by similar means, thereby forming a continuous belt shaped member; or, a continuous belt shaped member maybe formed from the start. The intermediate transfer belt 14 is arranged such that the lower side travelling area thereof can contact the photosensitive drums 10Y, 10M, 10C and 10K of the respective image forming units 7Y, 7M, 7C and 7K.

Also, in the intermediate transfer belt 14, as shown in FIG. 2, there is provided a secondary transfer roller 20 disposed on the lower end portion of the upper side travelling area of the intermediate transfer belt 14, serving as a secondary transfer unit for secondarily transferring the toner images which were primarily transferred onto the intermediate transfer belt 14 since the secondary transfer roller 20 contacts the surface of intermediate transfer belt 14 which is held and pulled by the back surface support roller 17.

The toner images of the respective colors, that is, yellow (Y), magenta (M), cyan (C) and black (K) transferred onto the intermediate transfer belt 14 overlapping each other, as shown in FIG. 2, and are secondarily transferred by the secondary transfer roller 20 pressed against the back surface support roller 17 onto a recording sheet 21 serving as a recording medium by electrostatic force. Then, the recording sheet 21 with the respective colors toner images transferred thereon is conveyed to a fixing device 30 according to the present exemplary embodiment which is disposed at a position vertically upward from the secondary transfer roller 20. The secondary transfer roller 20 is pressed against the side of the back surface support roller 17 and is able to secondarily transfer the respective color toner images all at once onto the recording sheet 21 which is delivered from below to above in the vertical direction.

The secondary transfer roller 20, for example, may be produced in the following manner: that is, a core metal is made of metal such as stainless steel, and the outer periphery of the core metal is covered to a predetermined thickness with an elastic layer made of a conductive elastic member formed of rubber material or the like with a conductive agent added thereto.

And, the recording sheet 21, to which the respective colors toner images have been transferred, is processed and fixed under heat and pressure by the fixing device 30 according to the present exemplary embodiment and, after that, it is discharged by discharge rollers 22 onto a discharge tray 23 disposed above the color image forming apparatus 1 in such a manner that the image surface thereof faces downward.

The recording sheets 21, as shown in FIG. 2, each having predetermined size and material, are supplied from a sheet supply tray 24 disposed at the bottom portion of the color image forming apparatus 1 by a sheet supply roller 25 and sheet separating and delivering rollers 26 in such a manner that they are separated one by one from each other, to resist rollers 27, and are stopped there temporarily. Then, the recording sheets 21 supplied from the sheet supply tray 24 are sent out to the secondary transfer position of the intermediate transfer belt 14 by the resist rollers 27 which can be rotated at a given timing. As the recording sheet 21, besides normal paper, there can be supplied a thick paper such as a coated paper coated on one surface or both surfaces by executing a coating processing. To the recording sheet 21 made of the coated paper, there can be output a picture image and the like.

The surface of the intermediate transfer belt 14, after the step of secondarily transferring the toner images thereon has been finished, is cleaned by a belt cleaning device 28 to thereby remove toners remaining there, thus preparing for the next image forming step. Here, in FIG. 2, reference numeral 29 designates a power supply portion which is used to supply electric power to the respective portions of the color image forming apparatus 1.

Figure 3:
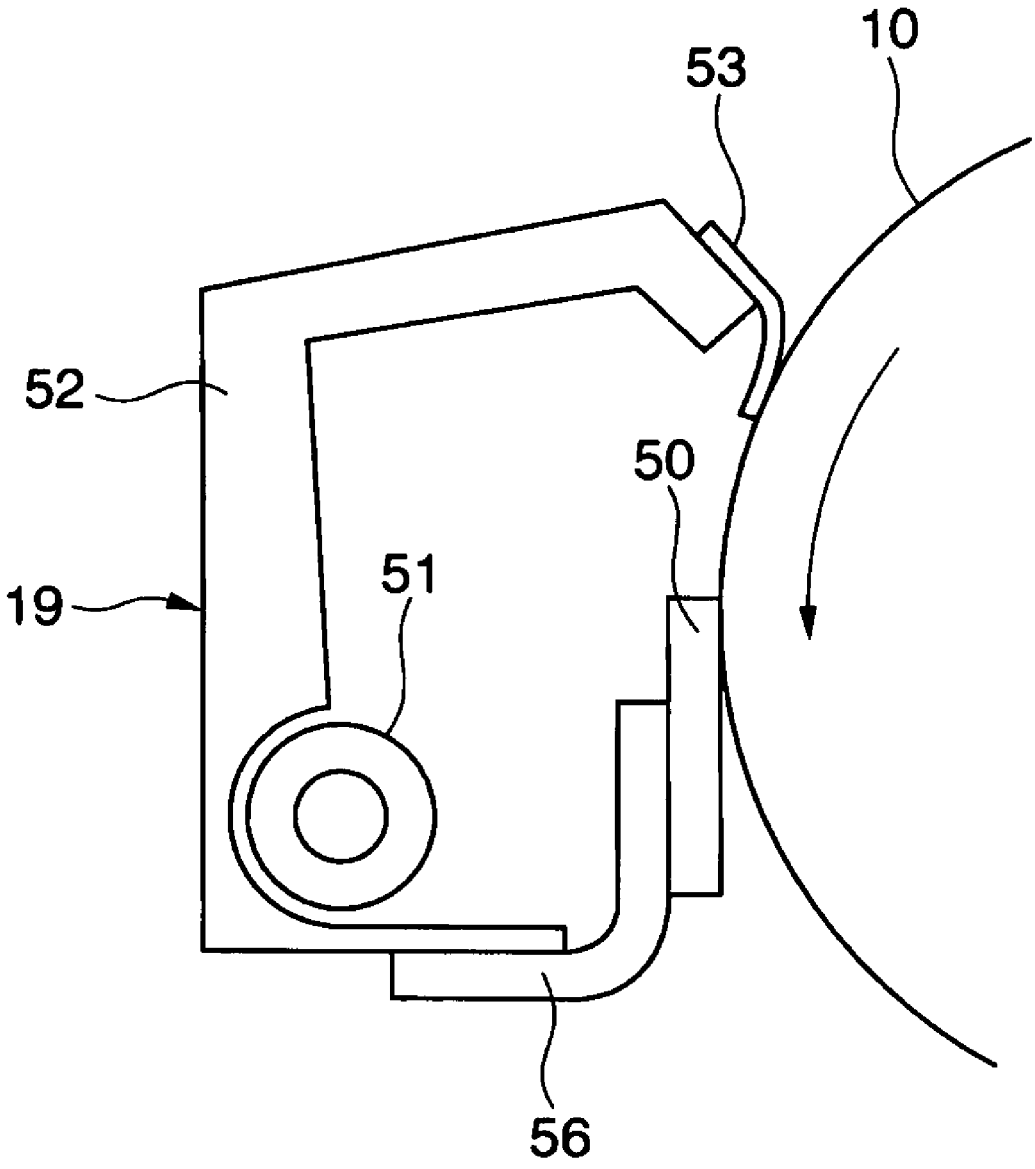
FIG. 3 is a structure view of a cleaning device according to the exemplary embodiment 1 of the invention.

Now, FIG. 3 is a structure view of a cleaning device which is used in the color image forming apparatus according to the exemplary embodiment 1 of the invention.

The present cleaning device 19, as shown in FIG. 3, includes a cleaning blade 50 serving as a blade member for cleaning which can contact the surface of the photosensitive drum 10, and a discharge auger 51 which can be driven and rotated at a predetermined timing to discharge the remaining toners or the like removed by the cleaning blade 50 to the outside. Also, the cleaning device 19 is structured such that a space between a cleaning device housing 52 and photosensitive drum 10 on the rotation direction upstream side of the photosensitive drum 10 is sealed by a seal member 53.

Figure 1:
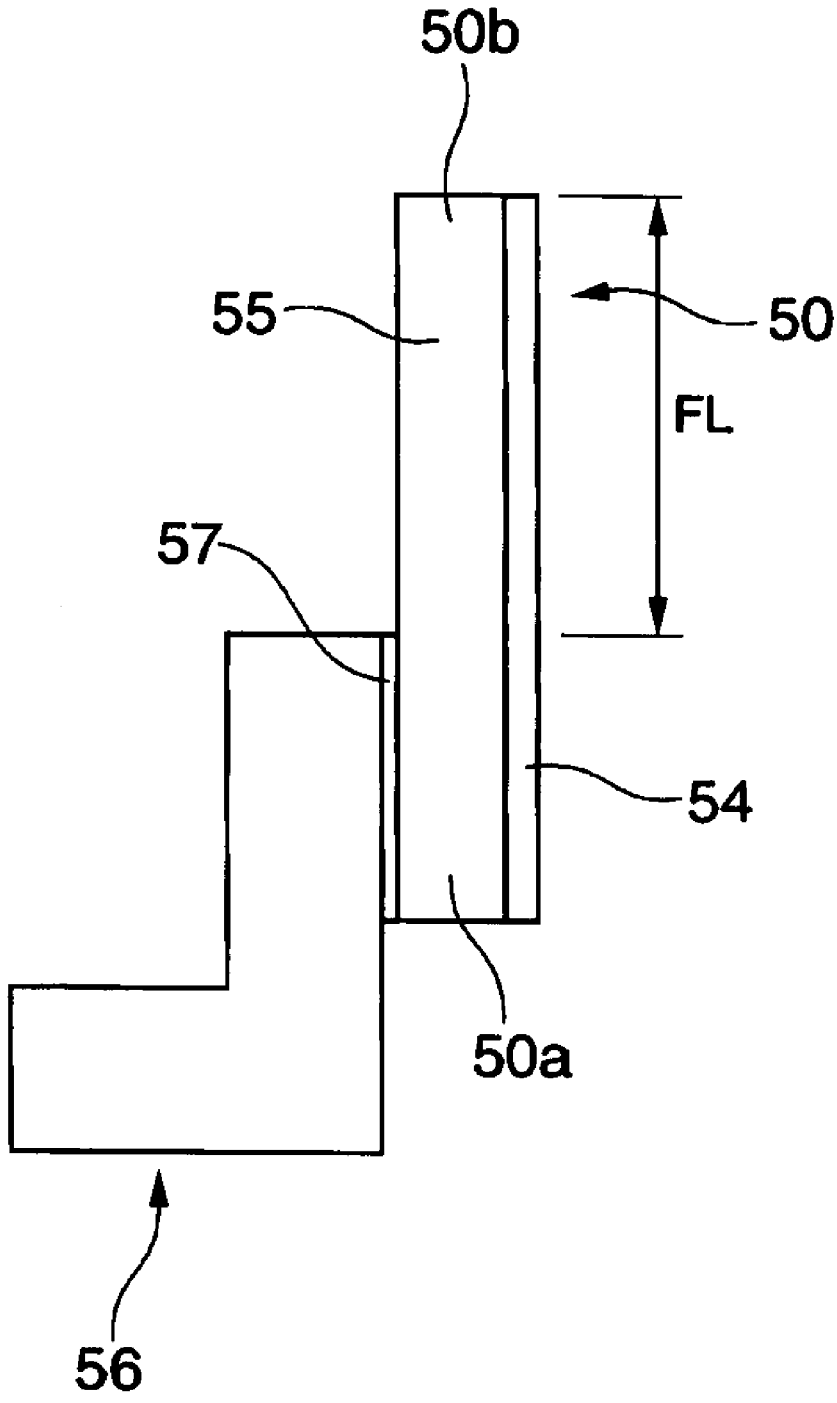
FIG. 1 is a structure view of the main portions of a cleaning device according to an exemplary embodiment 1 of the invention.

As the cleaning blade 50, for example, as shown in FIG. 1, there is used a cleaning blade having a layer structure of at least two (multiple) layers in which a cleaning layer 54 made of urethane rubber or the like differing in the physical property and a back surface support layer 55 are overlapped into an integral body. Although this cleaning blade 50 includes the cleaning layer 54 and back surface support layer 55, for example, it may also include another layer on the side opposite from the photosensitive drum 10, that is, it may have a structure which includes three or more layers.

The cleaning layer 54 of the cleaning blade 50 is made of material having JIS-A hardness of about 70-90 degrees, for example, urethane rubber with JIS-A hardness of 78 degrees, while the thickness of the cleaning layer 54 is set on the order of 0.5 mm. Also, the back surface support layer 55 of the cleaning blade 50 is made of material having JIS-A hardness of about 50-70 degrees, for example, urethane rubber with JIS-A hardness of 63 degrees, while the thickness of the back surface support layer 55 is set on the order of 1.4 mm. Thus, the back surface support layer 55 is formed thicker than the cleaning layer 54. Here, the cleaning layer 54 and back surface support layer 55 may also be made of other material than urethane rubber, such as chloroprene rubber, butadiene rubber, fluoro rubber, silicone rubber or acrylic rubber, provided that it has proper elasticity and hardness.

Also, the cleaning blade 50 is structured such that, as shown in FIG. 1, the base end portion 50*a* thereof is glued by an adhesive agent 57 such as a hot melt to a plate metal holder 56 serving as a holding member made of a galvanized steel plate having an L-like bent section and having a thickness of about 2 mm.

Further, for the cleaning layer 54 and back surface support layer 55, there are selected materials which have different coefficients of linear expansion expressing their coefficients of thermal expansion, the coefficient of linear expansion of the cleaning layer 54 set larger than the coefficient of linear expansion of the back surface support layer 55. Also, the coefficient of linear expansion of the adhesive agent 57 for gluing the cleaning blade 50 to the plate metal holder 56 is set smaller than that of the back surface support layer 55 of the cleaning blade 50. As a result of this, the coefficients of linear expansion of the cleaning layer 54, back surface support layer 55 and adhesive agent 57 satisfy the relationship: cleaning layer 54>back surface support layer 55>adhesive agent 57.

Also, various types of urethane, the material of the cleaning layer 54 and back surface support layer 55 of the cleaning blade 50, which have various physical properties are available. According to the present exemplary embodiment, as the back surface support layer 55 which is relatively large in thickness, there is used a urethane rubber material the permanent elongation property of which is set small in order that the permanent set of the cleaning blade 50 can be reduced. For example, there is used a urethane rubber material which when left in a state where it is elongated 100% for 72 hours in a high temperature and high humidity environment (45° C., 95% RH), has permanent elongation of 1% or less.

The index of the "permanent elongation" physical property of a blade rubber member is the measurement in the case where a member which has been receiving an external force continuously has the external force is removed, and the member cannot return to its original state elastically. The measuring method is based on JIS K 6262 and the "permanent elongation" physical property is measured under the following conditions. That is, a blade rubber member to be measured is cut into a short piece having a width of 5 mm, there are drawn bench marks on this short piece at intervals of 100 mm, and an elongation force is applied to the piece in the longitudinal direction to expand it up to an elongation percentage of 100%. The elongation speed is 500 mm/min. After the 100% elongation state is maintained for a predetermined time, the elongation force is relaxed at the speed of 1000 mm/min. 20 minutes after the end of the relaxation of the elongation force, the interval between the bench marks is measured using a vernier caliper. Where the length of the interval between the bench marks after the elongation is loosened is expressed as L (mm), the permanent elongation can be expressed as $$((L/100)-1)\times 100[\%]$$

The coefficient of thermal expansion of a solid body according to the invention is defined as the coefficient of linear expansion α. This can be defined as the rate of change in a unit length due to temperature. Therefore, the length D of a body at the temperature of T° C. can be expressed as $$D=d(1+\alpha\times\Delta T)$$

Here, d expresses the length of a body at the reference temperature t, while ΔT=T−t. According to the invention, similarly to the above-mentioned "permanent elongation" physical property measurement, there is prepared a short piece of the body to be measured, bench marks are drawn at the intervals of 100 mm, and a vernier caliper is used to measure the length between the bench marks d when t=10° C. and D when T=28° C., these temperatures chosen based on the use environment of the blade, thereby finding the coefficient of linear expansion α. Here, the measurement is made on condition that the time period that the body to be measured is left in the respective temperature environments is set at 14 hours.

Figure 5:
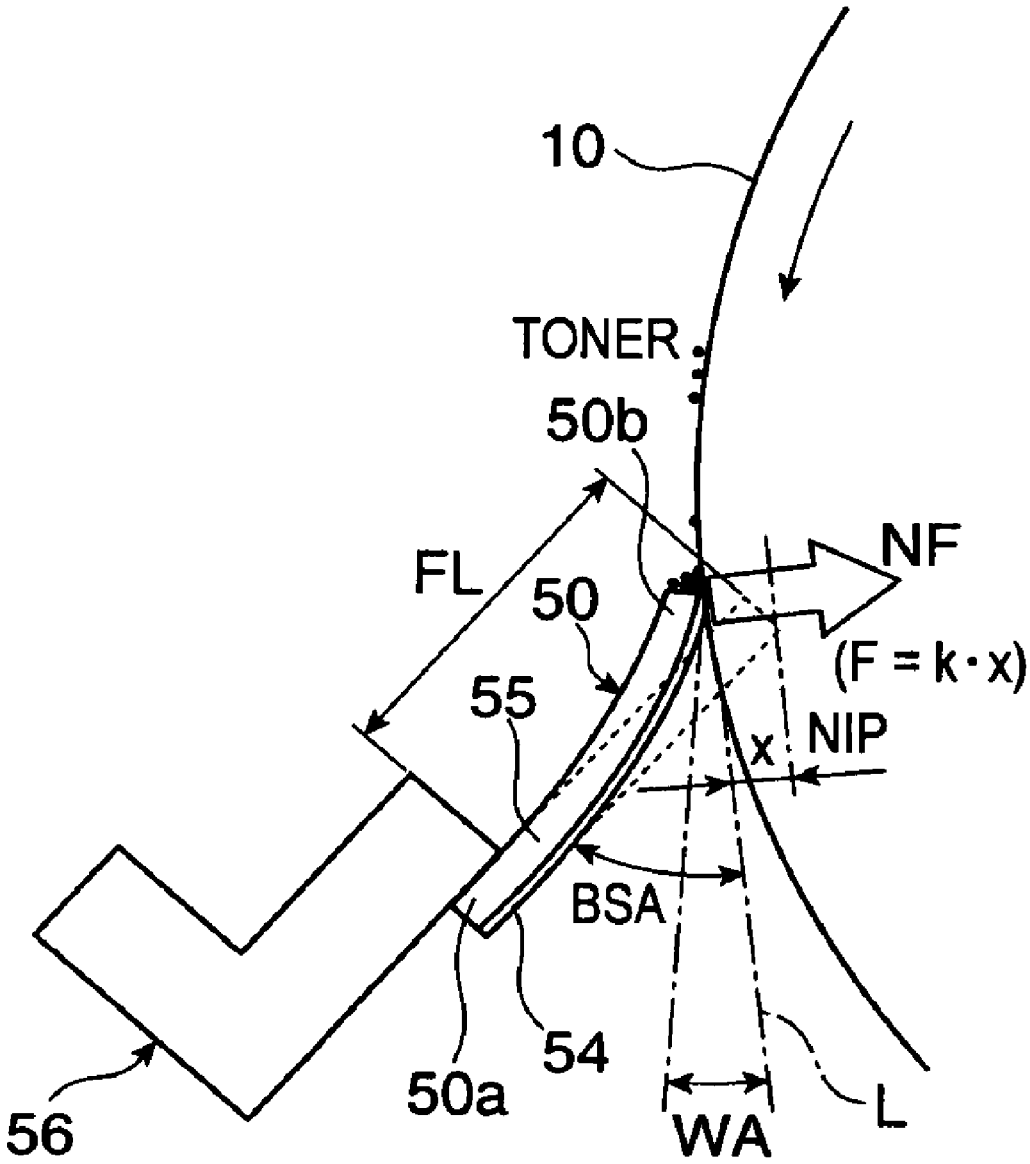
FIG. 5 is a structure view of the cleaning blade, showing its installed state.

Also, the cleaning blade 50 is a so called "doctor blade" structured such that, as shown in FIG. 5, with respect to the surface of the photosensitive drum 10 serving as a member to be cleaned, the base end portion 50*a* thereof is situated on the downstream side along the rotation direction of the photosensitive drum 10, the leading end portion 50*b* thereof is situated on the upstream side along the rotation direction of the photosensitive drum 10, and the blade 50 extends to contact the surface of the photosensitive drum 10 from the direction opposite to the rotation direction of the photosensitive drum 10.

Further, in the cleaning blade 50, as shown in FIG. 5, the length of the portion of the leading end side of the cleaning blade 50 except for the base end portion 50*a* fixed to the plate metal holder 56 is referred to as the free length (FL); and also, the angle between the base end portion 50*a* of the cleaning blade 50 and the tangent L of the surface of the photosensitive drum 10 that contacts the leading end portion 50*b* of the cleaning blade 50 is referred to as the blade setting angle (BSA), and the angle between the leading end portion 50*b* of the cleaning blade 50 and the tangent L is referred to as the wrap angle (WA), respectively. Also, when the photosensitive drum 10 is removed while the cleaning blade 50 is fixed at its installed position, the distance between the leading end portion 50*b* of the cleaning blade 50 and the above tangent L is referred to as the nip amount (x), and the nip force (NF), with which the cleaning blade 50 contacts the surface of the photosensitive drum 10, can be expressed as $F=k\cdot x$. Here, k is a constant.

The above-mentioned free length (FL), blade setting angle (BSA), wrap angle (WA), nip amount (x) and nip force (NF) are the parameters that determines the properties of the cleaning blade 50.

In the above structure, the cleaning device according to this exemplary embodiment can keep the blade from rolling up at the edge and avoid increased wear of the blade which, in a high temperature environment, which can be caused by the increased elastic repulsion of the rubber material constituting the blade member for cleaning, and also, in a low temperature environment, can prevent the cleaning performance of the blade member for cleaning from being lowered due to the decreased elastic repulsion of the rubber material constituting the blade member for cleaning.

That is, in the color image forming apparatus, as shown in FIG. 2, the toner images of the respective colors, that is, yellow (Y), magenta (M), cyan (C) and black (K) are formed by their associated image forming units 7Y, 7M, 7C and 7K for yellow (Y), magenta (M), cyan (C) and black (K), the respective colors toner images formed on the respective photosensitive drums 10 of the image forming units 7Y, 7M, 7C and 7K are primarily transferred in an overlapping manner onto the intermediate transfer belt 14, and the color toner images are then secondarily transferred all at once from the intermediate transfer belt 14 onto the recording sheet 21 and are fixed, thereby forming a full color image and the like.

Figure 6:
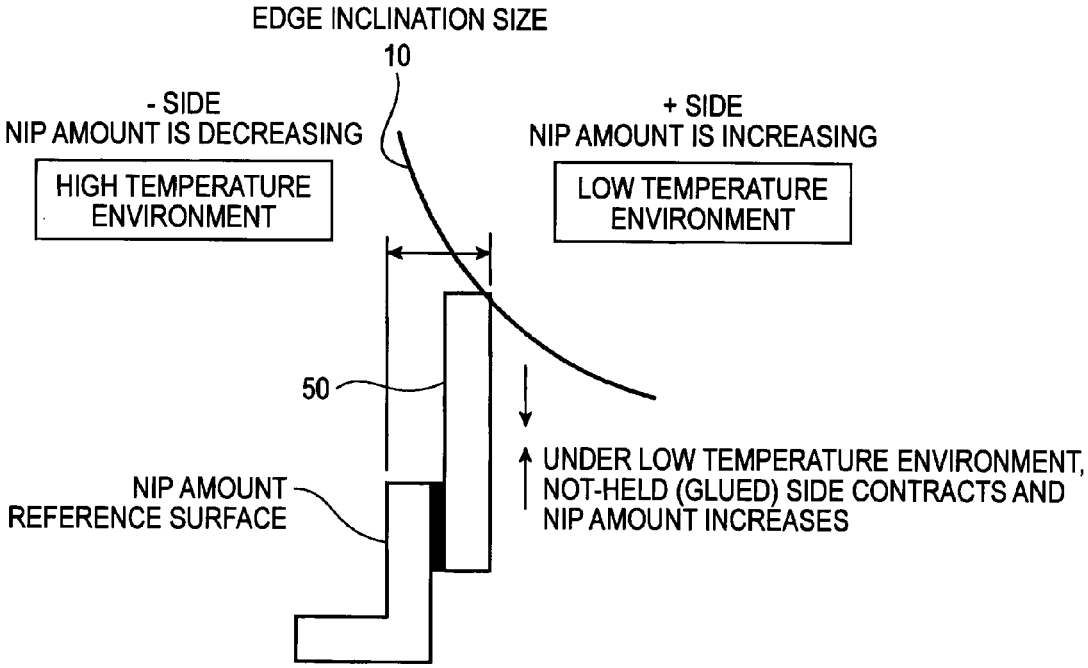
FIG. 6 is a structure view of the shifting direction of the cleaning blade.

And, in the image forming units 7Y, 7M, 7C and 7K respectively for yellow (Y), magenta (M), cyan (C) and black (K), when a step of transferring the toner images from the photosensitive drums 10 onto the intermediate transfer belt 14 is ended, the surfaces of the photosensitive drums 10 are cleaned by the cleaning device 13 to thereby remove the remaining toners therefrom. In the cleaning device 13, as shown in FIG. 3, the transfer residual toners and the like remaining on the surfaces of the photosensitive drums 10 are removed by the cleaning blade 50. In this case, the coefficient of linear expansion of the cleaning layer 54 of the cleaning blade 50 is set larger than the coefficient of linear expansion of the back surface support layer 55 of the cleaning blade 50; and thus, under the high temperature environment, the amount of thermal expansion of the cleaning layer 54 of the cleaning blade 50, as shown in FIG. 6, is larger than that of the back surface support layer 55, and the cleaning blade 50 is thereby shifted slightly in the separating direction from the surface of the photosensitive drum 10 due to a bimetal effect.

As a result of this, under the high temperature environment, since the hardness of the cleaning blade 50 is lowered and the elastic repulsion rate thereof is raised, the frictional force of the cleaning blade 50 with respect to the photosensitive drum 10 tends to increase. However, since the cleaning blade 50 shifts slightly in the separating direction from the surface of the photosensitive drum 10, an increase in the frictional force between the cleaning blade 50 and the surface of the photosensitive drum 10 can be restricted, thereby preventing the cleaning blade 50 from turning up at the edge and preventing an increase in the wear of the edge portion of the cleaning blade 50. This can prevent shortening of the life of the cleaning blade 50.

On the other hand, since the coefficient of linear expansion of the cleaning layer 54 of the cleaning blade 50 is set larger than that of the back surface support layer 55, in a low temperature environment, the amount of thermal contraction of the cleaning layer 54 is larger than that of the back surface support layer 55 and the cleaning blade 50 shifts slightly in the direction where it comes into contact with the surface of the photosensitive drum 10.

As a result of this, under the low temperature environment, since the hardness of the cleaning blade 50 is raised and the elastic repulsion rate thereof is lowered, the frictional force of the cleaning blade 50 with respect to the photosensitive drum 10 tends to decrease. However, since the cleaning blade 50 is slightly shifted due to the bimetal effect in the direction to come into contact with the surface of the photosensitive drum 10, as shown in FIG. 6, the frictional force between the cleaning blade 50 and the surface of the photosensitive drum 10 can be secured, thereby preventing the cleaning performance of the cleaning blade 50 from being lowered.

Also, according to the present exemplary embodiment, the coefficient of linear expansion of the adhesive agent 57 is set smaller than that of the back surface support layer 55 of the cleaning blade 50. Therefore, under the high temperature environment, the amount of thermal expansion of the adhesive agent 57 for gluing the cleaning blade 50 to the plate metal holder 56 can be prevented from exceeding that of the back surface support layer 55 of the cleaning blade 50, which, as described above, allows the cleaning blade 50 to shift slightly in the separating direction from the surface of the photosensitive drum 10.

Similarly, in a low temperature environment as well, the thermal contraction of the adhesive agent 57 for gluing the cleaning blade 50 to the plate metal holder 56 is prevented from exceeding that of the back surface support layer 55 of the cleaning blade 50, which, as described above, allows the cleaning blade 50 to shift slightly in the direction to come into contact with the surface of the photosensitive drum 10.

Here, the amount of shift of the cleaning blade 50 is determined by the coefficient of linear expansion of the urethane rubber material constituting the cleaning layer 54 and back surface support layer 55. As the material for constituting the cleaning layer 54 and back surface support layer 55, there is selected urethane rubber material the coefficient of linear expansion of which can be adjusted properly or which is predetermined.

Also, since the thickness of the cleaning blade 50 is relatively small when compared with the length thereof, basically, there is no need to take the thermal expansion of the cleaning blade 50 in the thickness direction into consideration.

Further, according to the present exemplary embodiment, as described above, even when, in the high and low temperature environments, the predetermined cleaning performance of the cleaning blade 50 can be provided due to the deformation of the cleaning blade 50, if, the cleaning blade is left for a long period of time in the same environment and in a state where it is nipping at the surface of the photosensitive drum 10, there is danger that the cleaning blade 50 can sag, impairing its elastic repulsion and lowering the nip pressure of the cleaning blade 50, which would thereby degrade the cleaning performance thereof.

Figure 4:
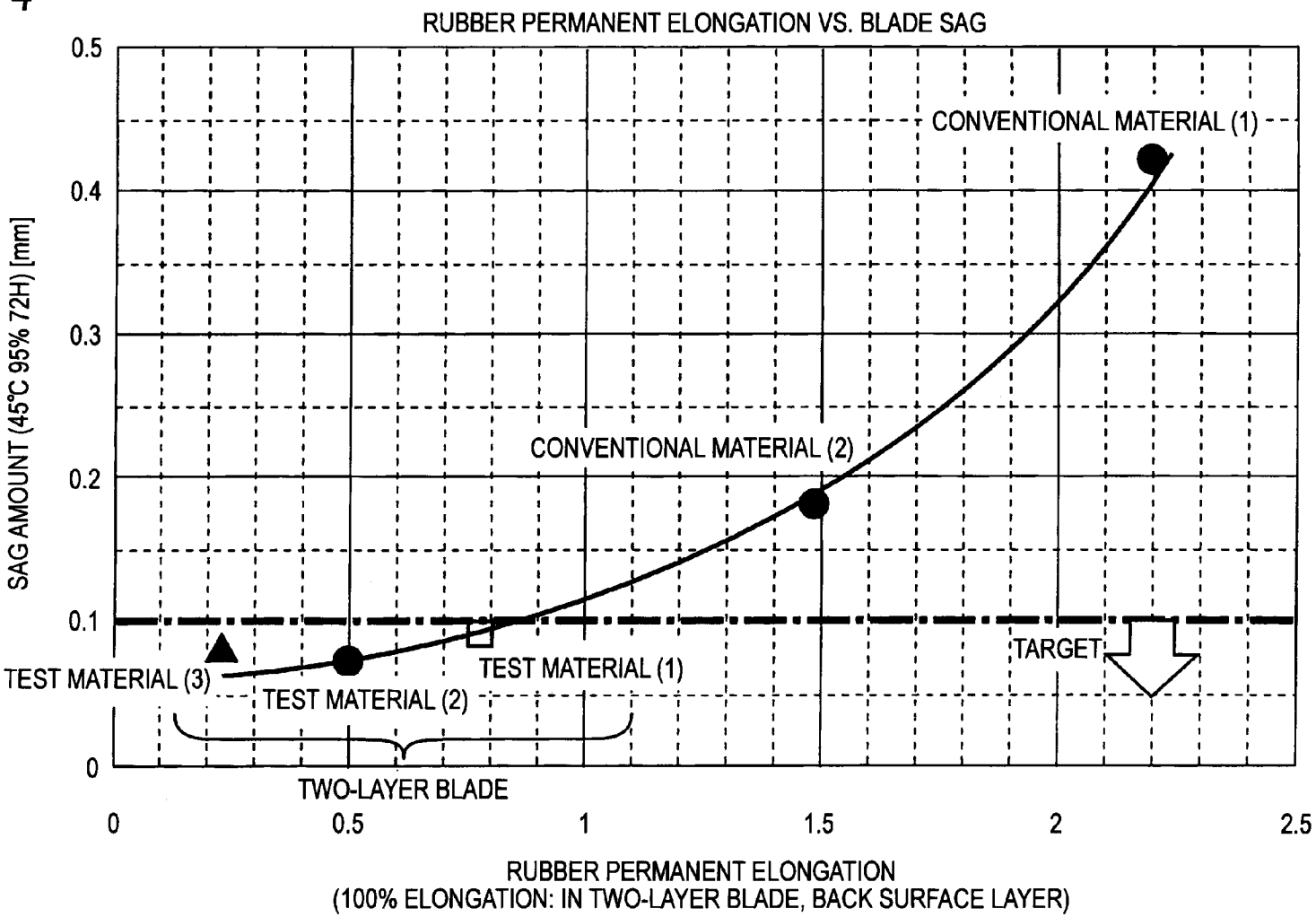
FIG. 4 is a graphical representation of the permanent elongation property of the rubber material of a cleaning blade.

Accordingly, according to the present exemplary embodiment, for the back surface support layer 55 of the cleaning blade 50, there is used rubber material made up of urethane material whose permanent elongation is less than 1.0, whereby, in a state where the cleaning blade 50 is in contact with the member to be cleaned with a nip (x) of 1.0 mm, the amount of sag of the cleaning blade 50 after the cleaning blade 50 is left for 72 hours under a high temperature and high humidity environment (45° C., 95% RH), as shown in FIG. 4, can be made 0.1 mm or less which is a target amount.

EXAMPLE

The present inventors et al. make a cleaning blade shown in FIG. 1 experimentally, mount it onto a color image forming apparatus shown in FIG. 2 and confirm the cleaning performance thereof.

For the cleaning blade 50, the cleaning layer 54 is made of urethane-made rubber material having a JIS-A hardness of 78 degrees and having a thickness of 0.5 mm, and the back surface support layer 55 is made of urethane-made rubber material having a JIS-A hardness of 63 degrees and having a thickness of 1.4 mm. The cleaning blade 50 is glued to the plate metal holder 56 made of a galvanized steel plate having a thickness of 2 mm using the hot melt adhesive agent 57 and is used.

Also, the cleaning blade 50 is pressed against the surface of the photosensitive drum 10 with the linear pressure of 3 gf/mm, while the angle of the surface of the plate metal holder 56 supporting the cleaning blade 50 with respect to the tangent of the sensitive drum surface at the contact point of the cleaning blade 50 with the photosensitive drum 10 is set at 25 degrees. Here, the free length (FL) of the cleaning blade 50 is set at 8 mm.

Further, in the cleaning blade 50, the cleaning layer 54 is made of material having a coefficient of linear expansion of $1.94\times10^{-4}$/° C., the back surface support layer 55 is made of material having a coefficient of linear expansion of $1.48\times10^{-4}$/° C., and the adhesive agent is made of material having a coefficient of linear expansion of $0.65\times10^{-4}$/° C.

Also, as a comparison example, there is used a cleaning blade in which the coefficients of linear expansion of the cleaning layer 54 and back surface support layer 55 of the cleaning blade 50 are reversed.

And, under the high temperature environment (30° C.) that is a severe condition causing nip of the blade against the roller and wear of the blade rubber material, images are printed successively on five recording sheets of A4 size repeatedly at the printing speed of 45 sheets per minute while the peripheral speed of the surface of the photosensitive drum 10 is 220 mm/S. After that, the variation in the nip at the surface of the photosensitive drum 10 of the cleaning blade 50 and the variation in the amount of wear of the blade edges with respect to the number of sheets printed are measured and evaluated.

Figure 7:
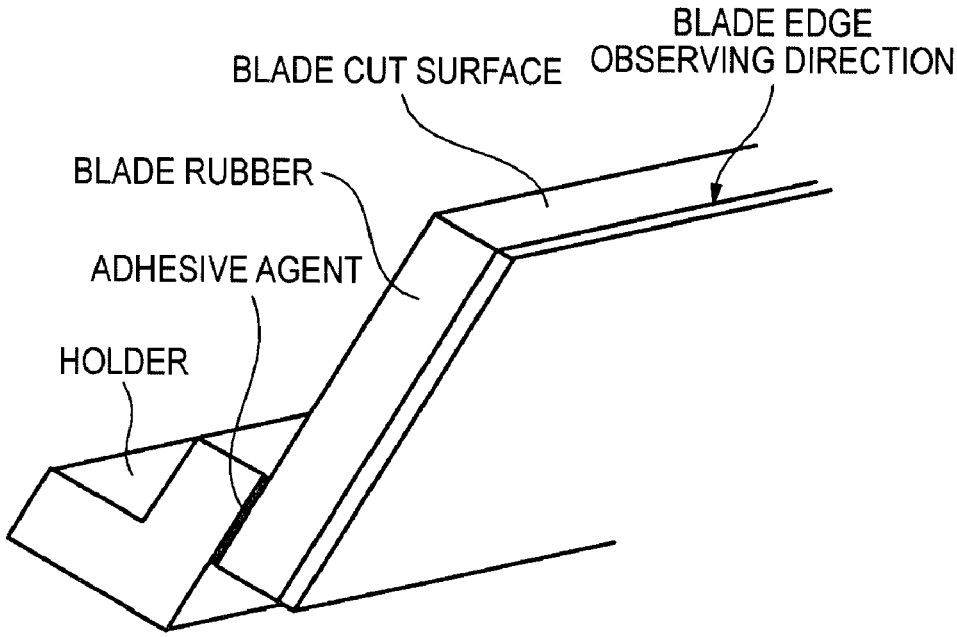
FIG. 7 is a structural outline of the cleaning blade viewed from the observing direction.
Figure 8:
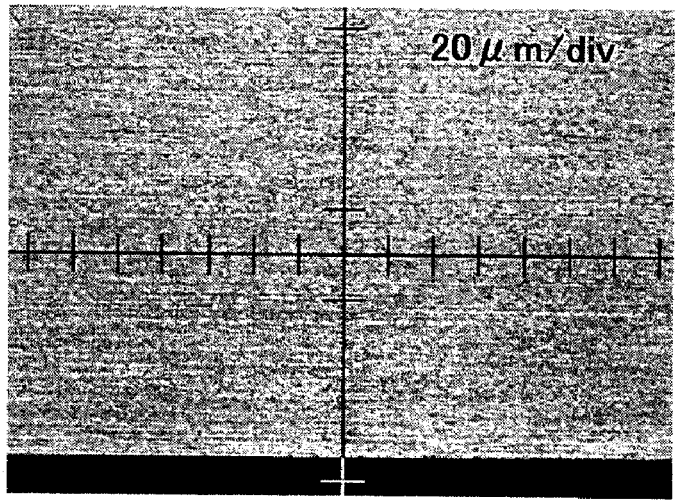
FIG. 8 is a view of a microscopic photograph of the edge of the cleaning blade.
Figure 9A:
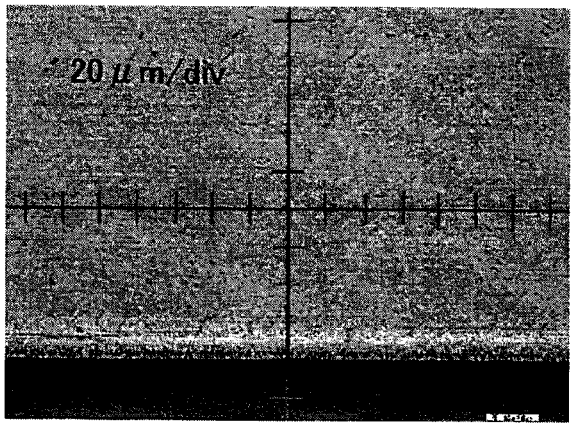
FIGS. 9A and 9B show a microscopic photograph of the edge of the cleaning blade, and its worn state.
Figure 9B:
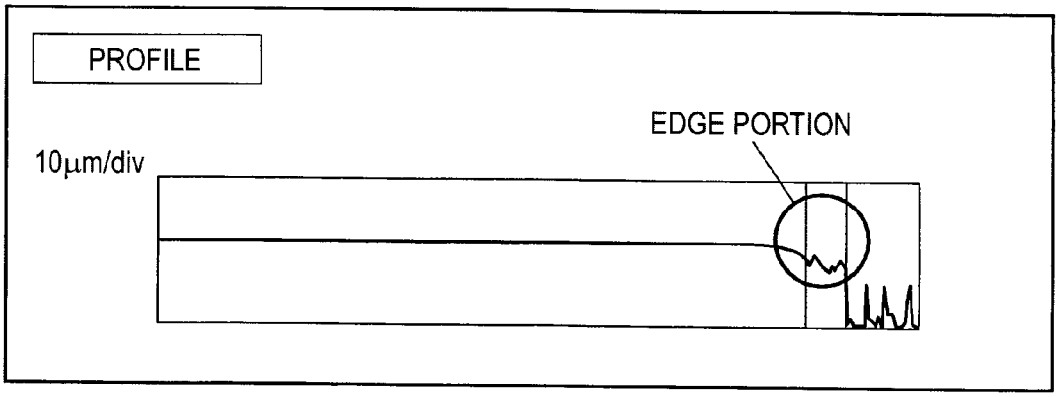

In this evaluation, the wear of the blade edge of the cleaning blade 50 is measured and it is checked whether the cleaning is poor or not. Here, the amount of wear of the blade edge is the worn section area that is found in the following manner. As shown in FIG. 7, the profile of the surface of the portion of the cut surface of the blade near the edge is observed using a laser microscope VK-8510 manufactured by Keyence Co. Ltd., and the difference in the cross section area between the blade edge with no wear as shown in FIG. 8 and the worn blade edge is calculated. An example of the worn state is shown in FIG. 9A, and an example of the blade edge profile of the worn state is shown in FIG. 9B. It is known that, when the cross section area worn away is large, the toner cleaning performance of the cleaning blade is lowered.

Also, the difference between the nip of the cleaning blade 50 measured under low temperature (10° C.) and under high temperature (30°) shows that, in the exemplary embodiment of the invention, the nip under the high temperature is smaller by 0.06 mm than under the low temperature. The nip corresponds to an amount of shift of the leading end of the cleaning blade 50. In the comparison example, the nip under the high temperature is larger by 0.07 mm than under the low temperature. That is, the measured results show that, between them, there is generated a difference in nip as large as 0.13 mm.

When this is converted to the difference in linear pressure of the cleaning blade 50 against the surface of the photosensitive drum 10, it is equivalent to a difference of approx. 0.39 gf/mm. The difference between loads applied to the cleaning blade 50 caused by such linear pressure difference provides the difference between the wear amounts of the blade edge as the number of sheets printed increases with time. This causes the difference in the time when the blade starts to clean poorly, which determines the difference in the life of the cleaning blades 50.

Figure 10:
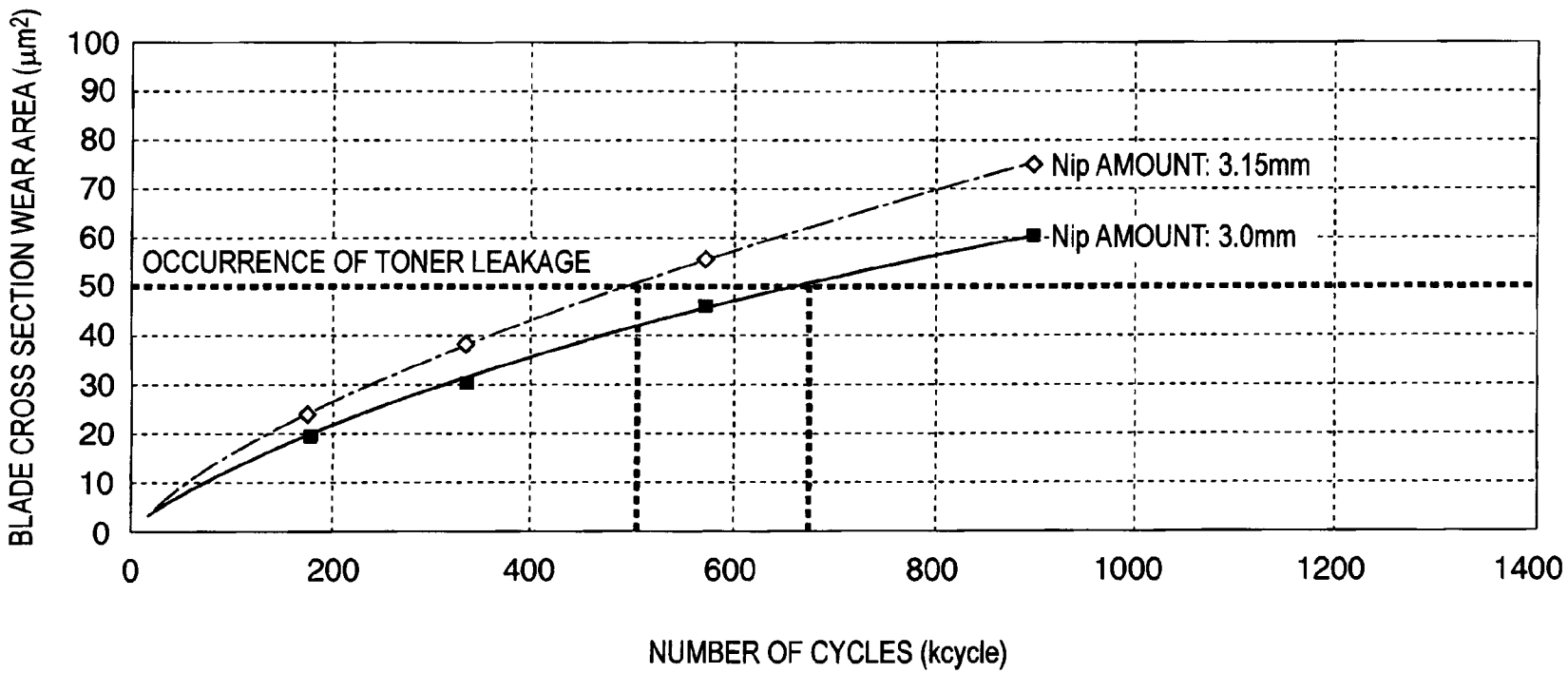

FIG. 10 is a graphical representation of the measurement results of the blade wear of the above exemplary embodiment.

As can be seen clearly from FIG. 10, when the nip of the cleaning blade 50 is 3.15 mm, about 500 kcyc (=500,000 cycles) pass before toner leakage occurs; and, when the nip with the cleaning blade 50 is 3.0 mm, about 680 kcyc (=680,000 cycles) pass before toner leakage occurs. That is, under the high temperature environment, when the leading end of the cleaning blade is shifted in the direction where the nip of the blade against the sensitive drum is reduced, the wear amount of the blade can be reduced, thereby extending the life of the blade.

What is claimed is:

1. A cleaning device comprising:

a cleaning blade that contacts a surface of a member to be cleaned to remove a residue remaining on the surface of the member to be cleaned, and that comprises a plurality of layers, wherein a leading end portion of the cleaning blade shifts in a separating direction from the surface of the member to be cleaned due to a difference in thermal expansion property among the plurality of layers when temperature rises.

2. A cleaning device comprising:

a cleaning blade member that contacts a surface of a member to be cleaned to remove a residue remaining on the surface of the member to be cleaned, and that comprises a plurality of layers, wherein a leading end portion of the cleaning blade member shifts in a separating direction from the surface of the member to be cleaned due to a difference in thermal expansion property among the plurality of layers when temperature rises; and a holding member that fixes and holds a base end portion of the cleaning blade member through an adhesive agent.

3. A cleaning device according to claim 2, wherein the cleaning blade member is structured such that a coefficient of thermal expansion of each of the plurality of layers is larger as the layer is closer to a cleaning layer side, which is situated on a side of the member to be cleaned, and is smaller as the layer is closer to a back surface layer side, which is situated on a side opposite from the member to be cleaned.

4. A cleaning device according to claim 2, wherein the cleaning blade member has a two layer structure including a cleaning layer which is situated on a side of the member to be cleaned, and a back surface layer which is situated on a side opposite from the member to be cleaned, a coefficient of thermal expansion of the cleaning layer is set larger than that of the back surface layer, and a coefficient of thermal expansion of the adhesive agent is set smaller than that of the back surface layer.

5. A cleaning device according to claim 2, wherein the cleaning blade member has a two layer structure including a cleaning layer which is situated on a side of the member to be cleaned, and a back surface layer which is situated on a side opposite from the member to be cleaned, and a material for the cleaning layer and a material for the back surface layer are different in permanent elongation property.

6. A cleaning device according to claim 4, wherein the cleaning blade member is structured such that a thickness of one layer among the two layers having a smaller permanent elongation property is set larger than a thickness of the other layer having a larger permanent elongation property.

7. An image forming apparatus comprising:

an image carrier that is rotatably driven to form a toner image on a surface thereof; and a cleaning blade member that contacts the surface of the image carrier to remove a residue remaining on the surface of the image carrier, and that comprises a plurality of layers, wherein a leading end portion of the cleaning blade member shifts in a separating direction from the surface of the image carrier due to a difference in thermal expansion property among the plurality of layers when temperature rises.

* * * * *